US011367404B2

(12) United States Patent
Wang et al.

(10) Patent No.: US 11,367,404 B2
(45) Date of Patent: Jun. 21, 2022

(54) DEVICE AND METHOD FOR CONTROLLING BACKLIGHT, AND DISPLAY DEVICE

(71) Applicants: BEIJING BOE DISPLAY TECHNOLOGY CO., LTD., Beijing (CN); BOE TECHNOLOGY GROUP CO., LTD., Beijing (CN)

(72) Inventors: Jianting Wang, Beijing (CN); Zhanchang Bu, Beijing (CN); Shou Li, Beijing (CN); Hengyu Yan, Beijing (CN); Xiaokang Hou, Beijing (CN)

(73) Assignees: BEIJING BOE DISPLAY TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/820,246

(22) Filed: Mar. 16, 2020

(65) Prior Publication Data

US 2021/0005150 A1 Jan. 7, 2021

(30) Foreign Application Priority Data

Jul. 4, 2019 (CN) ..... 201910598164.1

(51) Int. Cl.
*G09G 3/36* (2006.01)

(52) U.S. Cl.
CPC ..... *G09G 3/36* (2013.01); *G09G 2320/0247* (2013.01)

(58) Field of Classification Search
CPC .. G09G 3/36; G09G 2320/0247; H05B 41/12; H05B 41/04
See application file for complete search history.

(56) References Cited

U.S. PATENT DOCUMENTS

2002/0036608 A1* 3/2002 Hirakata ..... G02F 1/133604 345/87
2008/0094384 A1 4/2008 Fu
(Continued)

FOREIGN PATENT DOCUMENTS

CN 1763822 A 4/2006
CN 101154353 A 4/2008
(Continued)

OTHER PUBLICATIONS

First Chinese Office Action dated Jul. 2, 2021, for corresponding Chinese Application No. 201910598164.1, 21 pages.

*Primary Examiner* — Carolyn R Edwards
(74) *Attorney, Agent, or Firm* — Kinney & Lange, P.A.

(57) ABSTRACT

Embodiments of the present disclosure provide a device and a method for controlling backlight, and a display device. The device for controlling backlight, comprising: a first controlling circuit configured to receive a first power supply signal for controlling a display device to be turned on or off, and generate an output signal for causing a backlight module of the display device to be turned off, in response to the first power supply signal being in a first status for controlling the display device to be turned off; and a second controlling circuit configured to receive the first power supply signal, and generate an output signal for causing the backlight module to be turned on again after being kept in a turned off state for a predetermined time period, in response to the first power supply signal being in a second status for controlling the display device to be turned on.

16 Claims, 10 Drawing Sheets

(56) References Cited

U.S. PATENT DOCUMENTS

| | | | | |
|---|---|---|---|---|
| 2009/0109164 | A1* | 4/2009 | Um | H05B 41/282 315/90 |
| 2011/0279486 | A1 | 11/2011 | Kang | |
| 2016/0360488 | A1* | 12/2016 | Kapoor | H04W 52/0264 |

FOREIGN PATENT DOCUMENTS

| | | | |
|---|---|---|---|
| CN | 102665325 | A | 9/2012 |
| CN | 106710554 | A | 5/2017 |
| CN | 109215605 | A | 1/2019 |
| CN | 109587423 | A | 4/2019 |

* cited by examiner

DEVICE AND METHOD FOR CONTROLLING BACKLIGHT, AND DISPLAY DEVICE

CROSS-REFERENCE TO RELATED APPLICATION(S)

This application claims the priority of Chinese Patent Application 201910598164.1 filed on Jul. 4, 2019, the content of which is incorporated herein by reference.

TECHNICAL FIELD

The present disclosure relates to the field of display technology, and in particular, to a device and a method for controlling backlight, and a display device.

BACKGROUND

Display screens, especially liquid crystal display (LCD) screens may flicker when being turned on and off. There are many reasons for screen flickers. For example, the timing for respective signals is in chaos when turning on and off the device, especially when turning on and off the device quickly. This may cause the screen to emit light at a time that the screen is not expected to do so, thereby causing a screen flicker phenomenon.

SUMMARY

Embodiments of the present disclosure provide a device and a method for controlling backlight, and a display device.

According to an aspect of the embodiments of the present disclosure, there is provided a device for controlling backlight, comprising: a first controlling circuit configured to receive a first power supply signal for controlling a display device to be turned on or off, and generate an output signal for causing a backlight module of the display device to be turned off, in response to the first power supply signal being in a first status for controlling the display device to be turned off; and a second controlling circuit configured to receive the first power supply signal, and generate an output signal for causing the backlight module to be turned on again after being kept in a turned off state for a predetermined time period, in response to the first power supply signal being in a second status for controlling the display device to be turned on.

For example, the first controlling circuit includes a first transistor, a second transistor, a first diode, a first capacitor, a first resistor, and a second resistor. A first electrode of the first diode is electrically coupled to a first power supply signal terminal for providing the first power supply signal, and a second electrode of the first diode is electrically coupled to a first node. A first electrode of the first capacitor is electrically coupled to the first node, and a second electrode of the first capacitor is grounded. A controlling electrode of the first transistor is electrically coupled to a second node, a first electrode of the first transistor is electrically coupled to the first node, and a second electrode of the first transistor is electrically coupled to a third node. A first terminal of the first resistor is electrically coupled to the first power supply signal terminal, and a second terminal of the first resistor is electrically coupled to the second node. A first terminal of the second resistor is electrically coupled to the third node, and a second terminal of the second resistor is grounded. In addition, a controlling electrode of the second transistor is electrically coupled to the third node, a first electrode of the second transistor is grounded, and a second electrode of the second transistor is electrically coupled to a first outputting terminal for outputting the output signal from the first controlling circuit and the second controlling circuit.

For example, the first controlling circuit further includes a second capacitor and a third resistor. A first electrode of the second capacitor is electrically coupled to the third node, and a second electrode of the second capacitor is grounded. A first terminal of the third resistor is electrically coupled to the third node, and a second terminal of the third resistor is electrically coupled to the controlling electrode of the second transistor, so as to connect the controlling electrode of the second transistor to the second electrode of the first transistor via the third resistor.

For example, the first transistor is a P-type transistor and the second transistor is an N-type transistor.

For example, the second controlling circuit includes a third transistor, a third capacitor, and a fourth resistor. A first electrode of the third capacitor is electrically coupled to a first power supply signal terminal for providing the first power supply signal, and a second electrode of the third capacitor is electrically coupled to a fourth node. A first terminal of the fourth resistor is electrically coupled to the fourth node, and a second terminal of the fourth resistor is grounded. A controlling electrode of the third transistor is electrically coupled to the fourth node, a first electrode of the third transistor is grounded, and a second electrode of the third transistor is electrically coupled to a first outputting terminal for outputting the output signal from the first controlling circuit and the second controlling circuit.

For example, the second controlling circuit comprises a fourth transistor, a fifth transistor, a fourth capacitor, a fifth resistor, a sixth resistor, a seventh resistor, and a second diode. A controlling electrode of the fourth transistor is electrically coupled to a fifth node, a first electrode of the fourth transistor is grounded, and a second electrode of the fourth transistor is electrically coupled to a sixth node. A first electrode of the second diode is electrically coupled to the fifth node, and a second electrode of the second diode is electrically coupled to a first power supply signal terminal. A first electrode of the fourth capacitor is electrically coupled to the fifth node, and a second electrode of the fourth capacitor is grounded. A controlling electrode of the fifth transistor is electrically coupled to the sixth node via a seventh resistor, a first electrode of the fifth transistor is grounded, and a second electrode of the fifth transistor is electrically coupled to a first outputting terminal for outputting the output signal from the first controlling circuit and the second controlling circuit. A first terminal of the fifth resistor is electrically coupled to the first power supply signal terminal, and a second terminal of the fifth resistor is electrically coupled to the fifth node. A first terminal of the sixth resistor is electrically coupled to the first power supply signal terminal, and a second terminal of the sixth resistor is electrically coupled to the sixth node. A first terminal of the seventh resistor is electrically coupled to the sixth node, and a second terminal of the seventh resistor is electrically coupled to the controlling electrode of the fifth transistor.

For example, the device further comprises a third controlling circuit configured to invert the output signal generated by the first controlling circuit and the second controlling circuit, and output an inverted output signal via a second outputting terminal of the device for controlling backlight.

For example, the third controlling circuit includes a sixth transistor, an eighth resistor, and a ninth resistor. A first terminal of the eighth resistor is electrically coupled to a second power supply signal terminal for providing a second power supply signal, and a second terminal of the eighth resistor is electrically coupled to a first outputting terminal for outputting the output signal from the first controlling circuit and the secondo controlling circuit. A first terminal of the ninth resistor is electrically coupled to the second power supply signal terminal, and a second terminal of the ninth resistor is electrically coupled to the second outputting terminal. A controlling electrode of the sixth transistor is electrically coupled to the first outputting terminal, a first electrode of the sixth transistor is grounded, and a second electrode of the sixth transistor is electrically coupled to the second outputting terminal.

For example, the third controlling circuit further includes a third diode, a fifth capacitor, a tenth resistor, an eleventh resistor, and a voltage stabilizing diode. A first electrode of the third diode is electrically coupled to the second power supply signal terminal, and a second electrode of the third diode is electrically coupled to the first terminal of the eighth resistor and the first terminal of the ninth resistor. A first electrode of the fifth capacitor is coupled to the second electrode of the third diode, and a second electrode of the fifth capacitor is grounded. A first terminal of the tenth resistor is electrically coupled to the first outputting terminal, and a second terminal of the tenth resistor is electrically coupled to the controlling electrode of the sixth transistor, so as to connect the controlling electrode of the sixth transistor to the first outputting terminal via the tenth resistor. A first terminal of the eleventh resistor is electrically coupled to the controlling electrode of the sixth transistor, and a second terminal of the eleventh resistor is grounded. A first electrode of the voltage stabilizing diode is grounded, and a second electrode of the voltage stabilizing diode is electrically coupled to the second outputting terminal.

For example, the third controlling circuit includes a fourth diode, a seventh transistor, a sixth capacitor, a twelfth resistor, a thirteenth resistor, and a fourteenth resistor. A first electrode of the fourth diode is electrically coupled to a second power supply signal terminal for providing a second power supply signal, and a second electrode of the fourth diode is electrically coupled to a seventh node. A first terminal of the twelfth resistor is electrically coupled to the seventh node, and a second terminal of the twelfth resistor is electrically coupled to a first outputting terminal for outputting the output signal from the first controlling circuit and the second controlling circuit. A first electrode of the sixth capacitor is electrically coupled to the seventh node, and a second electrode of the sixth capacitor is grounded. A controlling electrode of the seventh transistor is electrically coupled to the eighth node, a first electrode of the seventh transistor is grounded, and a second electrode of the seventh transistor is coupled to the second outputting terminal. A first terminal of the thirteenth resistor is electrically coupled to the first outputting terminal, and a second terminal of the thirteenth resistor is electrically coupled to the eighth node. Further, a first terminal of the fourteenth resistor is electrically coupled to the eighth node, and a second terminal of the fourteenth resistor is grounded.

For another example, the device further comprises: a fourth controlling circuit, configured to provide a third power supply signal for powering the backlight module to a third outputting terminal of the device, based on the output signal generated by the first controlling circuit or the second controlling circuit.

For example, the fourth controlling circuit includes a fifteenth resistor and a switching transistor. A first terminal of the fifteenth resistor is electrically coupled to a third power supply signal terminal for providing the third power supply signal, and a second terminal of the fifteenth resistor is electrically coupled to a first outputting terminal for outputting the output signal from the first controlling circuit and the second controlling circuit. Further, a controlling electrode of the switching transistor is electrically coupled to the first outputting terminal, a first electrode of the switching transistor is electrically coupled to the third power supply signal terminal, and a second electrode of the switching transistor is electrically coupled to the third outputting terminal.

For example, the switching transistor is a MOSFET transistor.

For another example, the first power supply signal is a voltage signal for powering a display driving circuit in the display device.

For example, the predetermined time period is longer than the time required for the display driving circuit in the display device to be powered on.

For another example, the second power supply signal is the same as the first power supply signal, or a discharging duration required for the second power supply signal to change from a first level to a second level is longer than the discharging duration required for the first power supply signal to change from the first level to the second level.

According to another aspect of the embodiments of the present disclosure, there is provided a display device, comprising: the device for controlling backlight discussed above, and the backlight module, electrically coupled to the device for controlling backlight, and configured to be turned on or off under a control of the output signal provided by the device for controlling backlight.

According to another aspect of the embodiments of the present disclosure, there is provided a method for controlling backlight, executed by the above-mentioned device. The method comprises: receiving the first power supply signal for controlling the turning on or off of the display device; generating, by the first controlling circuit, an output signal for causing the backlight module of the display device to be turned off, in response to the first power supply signal being in the first status for controlling the display device to be turned off; and generating, by the second controlling circuit, an output signal for causing the backlight module to be turned on again after being kept in the turned off state for the predetermined time period, in response to the first power supply signal being in the second status for controlling the display device to be turned on.

DETAILED DESCRIPTION

Figure 1:
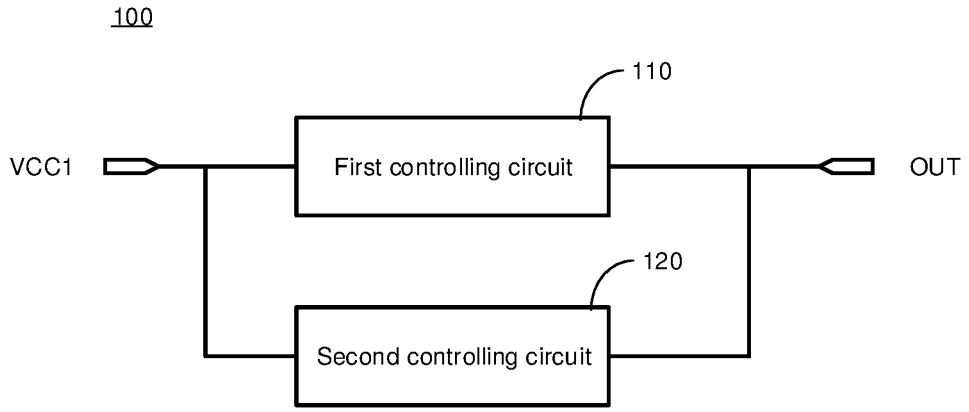
FIG. 1 shows a schematic block diagram illustrating a device for controlling backlight according to an embodiment of the present disclosure.

In order to make the objectives, technical solutions, and advantages of the embodiments of the present disclosure more clear, the technical solutions in the embodiments of the present disclosure will be described clearly and completely in combination with the drawings in the embodiments of the present disclosure. Obviously, described embodiments are part of the disclosure, but not all. Based on the described embodiments of the present disclosure, all other embodiments obtained by those skilled in the art without creative effort will belong to the scope defined by the embodiments of the present disclosure. It should be noted that throughout the drawings, the same elements are represented by the same or similar reference numerals. In the following description, some specific embodiments are used for description purposes only, and should not be construed as any limitation to the embodiments of the present disclosure, but merely as examples of the embodiments of the present disclosure. When it may cause confusion in the understanding of the embodiments of the present disclosure, a conventional structure or configuration will be omitted. It should be noted that the shapes and sizes of the components in the drawings do not reflect a true size and proportion, but merely illustrate the content of the embodiments of the present disclosure.

Unless otherwise defined, the technical terms or scientific terms used in the embodiments of the present disclosure shall have ordinary meanings as understood by those skilled in the art. Terms such as "first", "second" and similar words used in the embodiments of the present disclosure do not indicate any order, quantity, or importance, but are only used to distinguish different components.

In addition, in the description of the embodiments of the present disclosure, the terms such as "connected to" or "coupled to" indicates that two components are directly connected, or that two components are connected via one or more other components. In addition, these two components can be connected or coupled by wired or wirelessly.

In addition, in the description of the embodiment of the present disclosure, the terms of "first level" and "second level" are only used to distinguish the amplitudes of the two levels. For example, the description is made by taking "the first level" being a high level and "the second level" being a low level as an example. Those skilled in the art can understand that the embodiments of the present disclosure are not limited thereto.

In the display device, such as an LCD display module or an LCD display, the problem of screen flicker may be perceived. One of the reasons for the screen flicker is that the timing for powering on has been confused when the device is quickly turned on and off. Generally, it is expected that the backlight module could be turned on after the display driving circuit of the display device is powered on, such as, after various power supply voltages Vcore in a timing controller (T-Con) and voltages Vio at general purpose input/output (GPIO) terminals are stabilized. In the case of DC turning on and off, the display driving circuit is provided with a reset delay mechanism, which can prevent the screen flicker accompanied with the turning on and off of the display device, by accurately setting the timing of each signal. However, in the case of a fast turning on and off (such as an AC turning on and off), due to the difference of the load current and the load capacitance among power supply voltages in respective channels, and the randomness of the turning on and off, it may cause the signal timing to be chaotic. For example, when the power is turned on and off frequently, the backlight module may be turned on at an unexpected time because the voltage Vcore and the voltage Vio are not discharged to the minimum operating voltage or the reset circuit is not fully discharged, thereby causing the screen flicker accompanied with the turning on and off of the display device.

The screen flicker problem can be alleviated by setting appropriate capacitor parameters which may be obtained via repeated tests. However, the repeated tests cannot completely cover different switching frequency, and even for some complicated timing confusion, it is impossible to find a suitable capacitor parameter configuration, so the above-mentioned screen flicker problem cannot be actually solved.

The embodiments of the present disclosure provide a device and a method for controlling backlight, and a display device. By monitoring the power supply signal that controls the display device to be turned on or off, such as the first power supply signal for powering the T-CON, and controlling the backlight module to be turned on or off according to the power supply signal, it can alleviate the resulting screen flicker due to the signal timing confusion during powering-on.

FIG. 1 shows a schematic block diagram illustrating a device for controlling backlight according to an embodiment of the present disclosure. The device for controlling backlight can be applied to a display device having a backlight module.

As shown in FIG. 1, the device for controlling backlight 100 comprises a first controlling circuit 110 and a second controlling circuit 120. The first controlling circuit 110 may be configured to receive, at the first power supply signal terminal VCC1, a first power supply signal for controlling a display device to be turned on or off, and generate an output signal for causing a backlight module of the display device to be turned off, in response to the first power supply signal being in a first status for controlling the display device to be turned off. The second controlling circuit 120 may be configured to receive, at the first power supply terminal VCC1, the first power supply signal, and generate an output signal for causing the backlight module to be turned on again after being kept in a turned off state for a predetermined time period, in response to the first power supply signal being in a second status for controlling the display device to be turned on. The output signal can be output at the outputting terminal OUT of the device for controlling backlight 100, so as to control the turning on or off of the backlight module electrically connected to the outputting terminal OUT.

The first power supply signal terminal VCC1 may be a power supply signal terminal for powering the display driving circuit (such as a timing controller T-CON) in the display device. The first power supply signal at the first power supply signal terminal VCC1 may generally have a voltage of 5V or 12V. When the first power supply signal terminal VCC1 is at the first level (for example, a high level), the first power supply signal terminal VCC1 may provide the first power supply signal being in a second status for controlling the display device (for example, the timing controller T-CON of the display device) to be turned on, and when the first power supply signal terminal VCC1 is at the second level (for example, a low level), the first power supply signal terminal VCC1 may provide the first power supply signal being in a first status for controlling the display device (for example, the timing controller T-CON of the display device) to be turned off. The predetermined time period may be longer than the time required for the display driving circuit in the display device to be powered on, for example, longer than the time required for the power supply voltage Vcore in the timing controller T-CON, voltage Vio at GPIO terminals, other logic voltages and the like being stabilized.

Each of power supply voltage Vcore in the timing controller T-CON, voltage Vio at the GPIO terminal, other logic voltages and the like are all generated based on the voltage of the first power supply signal. Examples of the voltage Vcore may include, but are not limited to, 1.5V, 1.8V, and the like. When turning on/off the device, the voltage at the first power supply signal terminal VCC1 changes before other voltages. By monitoring the voltage at the first power supply signal terminal VCC1 and controlling the turning on or off of the backlight module accordingly, it is possible to avoid the screen flicker due to the chaotic internal signal timing when the display device is turned on and off.

An example circuit structure of a backlight control device according to an embodiment of the present disclosure will be described below with reference to FIGS. 2A and 2B. The device for controlling backlight of FIG. 2A and FIG. 2B can be applied to a high-level-enabled backlight module. For example, the outputting terminal of the backlight control device can be electrically coupled to the enabling signal terminal of the backlight module, which is high-level enabled.

Figure 2A:
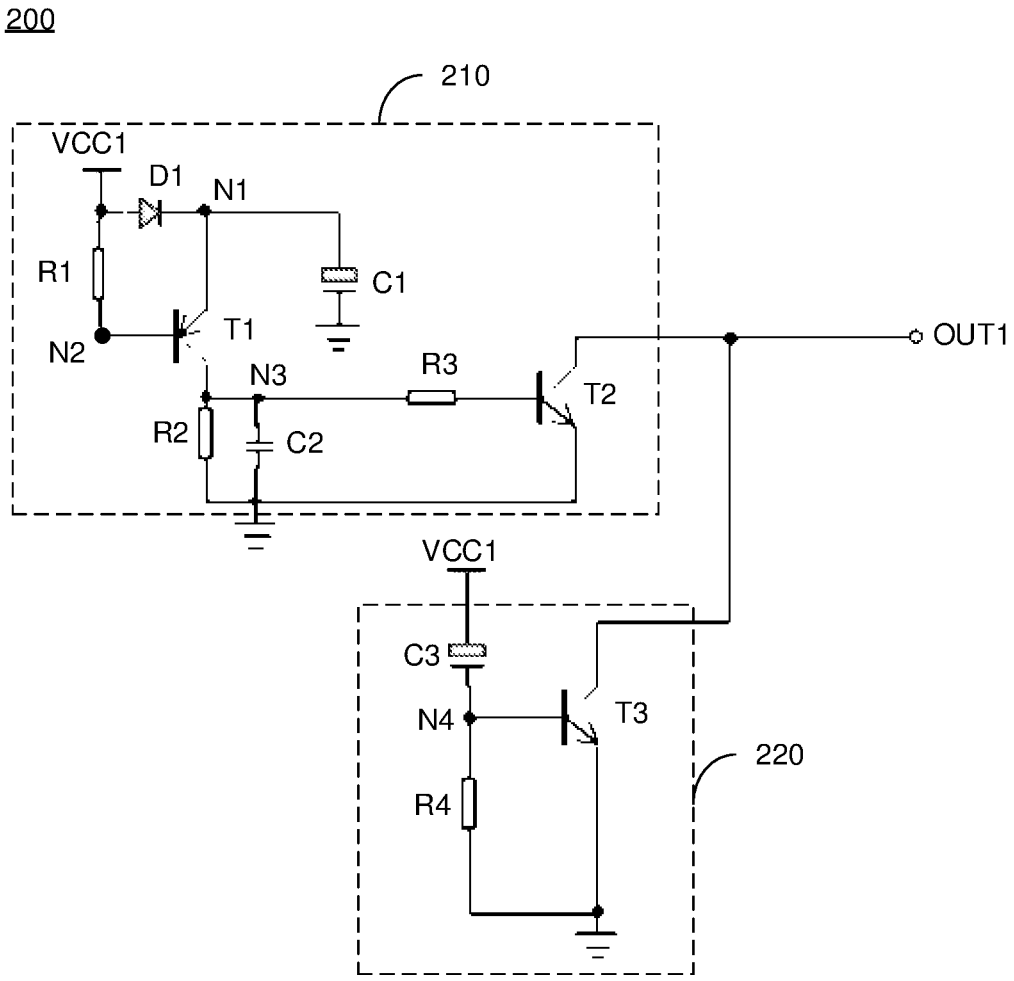
FIG. 2A shows a circuit diagram of the device for controlling backlight according to an embodiment of the present disclosure.

FIG. 2A shows a circuit diagram of the device for controlling backlight according to an embodiment of the present disclosure.

As shown in FIG. 2A, the device for controlling backlight 200 may comprise a first controlling circuit 210 and a second controlling circuit 220.

For example, the first controlling circuit 210 may include a first transistor T1, a second transistor T2, a first diode D1, a first capacitor C1, a first resistor R1, and a second resistor R2. A first electrode of the first diode D1 is electrically coupled to a first power supply signal terminal VCC1 for providing the first power supply signal, and a second electrode of the first diode D1 is electrically coupled to a first node N1. A first electrode of the first capacitor C1 is electrically coupled to the first node N1, and a second electrode of the first capacitor C1 is grounded. A controlling electrode of the first transistor T1 is electrically coupled to a second node N2, a first electrode of the first transistor T1 is electrically coupled to the first node N1, and a second electrode of the first transistor T1 is electrically coupled to a third node N3. A controlling electrode of the second transistor T2 is electrically coupled to the third node N3, a first electrode of the second transistor T2 is grounded, and a second electrode of the second transistor T2 is electrically coupled to a first outputting terminal OUT1 for outputting the output signal. A first terminal of the first resistor R1 is electrically coupled to the first power supply signal terminal VCC1, and a second terminal of the first resistor R1 is electrically coupled to the second node N2. A first terminal of the second resistor R2 is electrically coupled to the third node N3, and a second terminal of the second resistor R2 is grounded.

In some embodiments, as shown in FIG. 2A, the first controlling circuit 210 may further include a second capacitor C2 and a third resistor R3. A first electrode of the second capacitor C2 is electrically coupled to the third node N3, and a second electrode of the second capacitor C2 is grounded. A first terminal of the third resistor R3 is electrically coupled to the third node N3, and a second terminal of the third resistor R3 is electrically coupled to the controlling electrode of the second transistor T2, so as to connect the controlling electrode of the second transistor T2 to the second electrode of the first transistor T1 via the third resistor R3. By setting the second capacitor C2 and the third electron R3 in the first controlling circuit 210, it is possible to reduce the interference in the circuit, thereby stabilizing the signal at the first outputting terminal OUT1.

For example, the second controlling circuit 220 may include a third transistor T3, a third capacitor C3, and a fourth resistor R4. A first electrode of the third capacitor C3 is electrically coupled to a first power supply signal terminal VCC1 for providing the first power supply signal, and a second electrode of the third capacitor C3 is electrically coupled to a fourth node N4. A controlling electrode of the third transistor T3 is electrically coupled to the fourth node N4, a first electrode of the third transistor T3 is grounded, and a second electrode of the third transistor T3 is electrically coupled to a first outputting terminal OUT1 for outputting the output signal. A first terminal of the fourth resistor R4 is electrically coupled to the fourth node N4, and a second terminal of the fourth resistor R4 is grounded.

In FIG. 2A, the first transistor T1 is a P-type transistor, and the second transistor T2 and the third transistor T3 are N-type transistors. Obviously, the embodiments of the present disclosure are not limited to this, and other suitable types of transistors may be adopted as needed.

When turning on the device, the first power supply signal terminal VCC1 is at a high level, the first transistor T1 is turned off, the first controlling circuit 210 does not operate, and the third capacitor C3 in the second controlling circuit 220 starts to charge. During the charging of the third capacitor C3, the third transistor T3 is turned on, thereby pulling down the output signal of the first outputting terminal OUT1 to a low level, so that the enabling signal terminal of the backlight module is at a low level, and the backlight module does not emit light (that is, it is turned off). After a period of time, the charging of the third capacitor C3 is completed, the third transistor T3 is turned off, and the level at the first outputting terminal OUT1 is no longer pulled down, so that the enabling signal terminal of the backlight module returns to a high level, causing the backlight module to be turned on. For example, the third capacitor C3 and the fourth resistor R4 are set such that the charging time for the third capacitor C3 under the voltage of the first power supply signal terminal VCC1 equals to the above-mentioned predetermined time period, which may be longer than the timed required for respective power supply voltage Vcore in the timing controller T-CON, the voltage at the GPIO terminal, other logic voltages and the like being stabilized after being powered. Therefore, the second controlling circuit 220 can ensure that the enabling signal terminal of the backlight module is kept at a low level before the powering on of the timing controller T-CON is completed, and the level at the enabling signal terminal of the backlight module is stopped to be pulled down after the powering on of the timing controller T-CON is completed, thereby enabling the backlight module to be turned on normally.

When turning off the device, the first power supply signal terminal VCC1 is at a low level, the third transistor T3 is turned off, the second controlling circuit 220 does not operate. The first transistor T1 in the first controlling circuit 210 is turned on, so that the controlling electrode of the second transistor T2 is at a high level, turning on the second transistor T2. The turning on of the second transistor T2 cause the output signal of the first outputting terminal OUT1 to be pulled down to a low level, so that the enabling signal terminal of the backlight module is at a low level, and the backlight module is turned off.

Figure 2B:
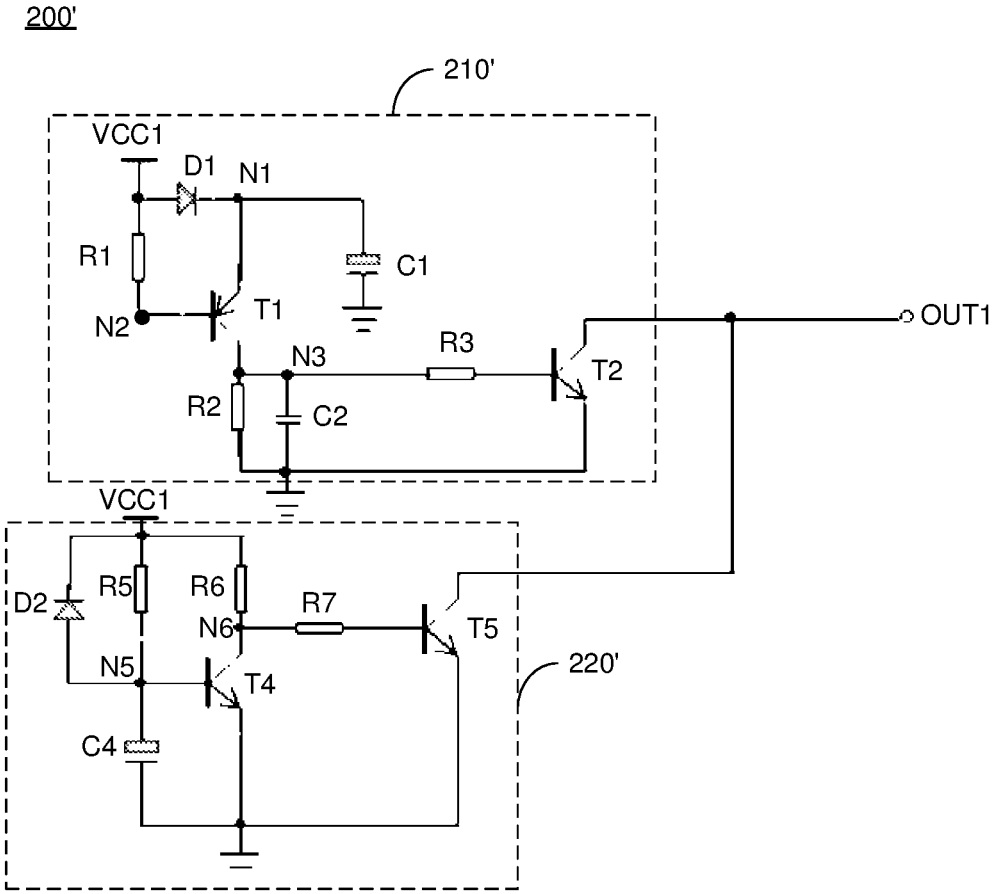
FIG. 2B shows a circuit diagram of the device for controlling backlight according to an embodiment of the present disclosure.

FIG. 2B shows a circuit diagram of the device for controlling backlight according to an embodiment of the present disclosure. The device for controlling backlight 200' of FIG. 2B is similar to the device for controlling backlight 200 of FIG. 2A, except for the second controlling circuit 220'. For brevity, the differences will be mainly described in detail below.

As shown in FIG. 2B, the device for controlling backlight 200' may comprise a first controlling circuit 210' and a second controlling circuit 220'. The first controlling circuit 210' may be implemented in the same way as the first controlling circuit 210 described above, which is not repeated here. The second controlling circuit 220' may comprise a fourth transistor T4, a fifth transistor T5, a fourth capacitor C4, a fifth resistor R5, a sixth resistor R6, a seventh resistor R7, and a second diode D2. A controlling electrode of the fourth transistor T4 is electrically coupled to a fifth node N5, a first electrode of the fourth transistor T4 is grounded, and a second electrode of the fourth transistor T4 is electrically coupled to a sixth node N6. A first electrode of the second diode D2 is electrically coupled to the fifth node N5, and a second electrode of the second diode D2 is electrically coupled to a first power supply signal terminal VCC1. A first electrode of the fourth capacitor C4 is electrically coupled to the fifth node N5, and a second electrode of the fourth capacitor C4 is grounded. A controlling electrode of the fifth transistor T5 is electrically coupled to the sixth node N6 via a seventh resistor R7, a first electrode of the fifth transistor T5 is grounded, and a second electrode of the fifth transistor T5 is electrically coupled to a first outputting terminal OUT1 for outputting the output signal. In this embodiment, the third transistor T3 and the fourth transistor T4 are both N-type transistors, however, the embodiments of the present disclosure are not limited thereto, and the type of the transistor may be selected as needed.

When turning on the device, the first power supply signal terminal VCC1 is at a high level, the first transistor T1 is turned off, the first controlling circuit 210' does not operate, and the fourth capacitor C4 in the second controlling circuit 220' starts to charge. During the charging of the fourth capacitor C4, the fourth transistor T4 is turned off and the fifth transistor T5 is turned on, thereby pulling down the output signal from the first outputting terminal OUT1 to a low level. After a period of time, the charging of the fourth capacitor C4 is completed, the fourth transistor T4 is turned on, causing the fifth transistor T5 to be turned off. Thus, the level at the first outputting terminal OUT1 is stopped to be pulled down, so that the enabling signal terminal of the backlight module may return to a high level, causing the backlight module to be turned on after being kept in a turned off state for a predetermined time period. The fourth transistor T4, the second diode D2, the sixth resistor R6, and the seventh resistor R7 functions to prevent interference, so that the voltage at the controlling electrode of the fifth transistor T5 is more stable.

When turning off the device, the first power supply signal terminal VCC1 is at a low level, the fifth transistor T5 is turned off, the second controlling circuit 220' does not operate. The first controlling circuit 210' may operate in a similar way as described above, to pull down the output signal of the first outputting terminal OUT1 to a low level, so that the enabling signal terminal of the backlight module is at a low level, and the backlight module is turned off.

An example circuit structure of a backlight control device according to another embodiment of the present disclosure will be described below with reference to FIGS. 3A and 3B. The device for controlling backlight of FIG. 3A and FIG. 3B can be applied to a low-level-enabled backlight module. For example, the outputting terminal of the backlight control device can be electrically coupled to the enabling signal terminal of the backlight module, which is low-level enabled.

Figure 3A:
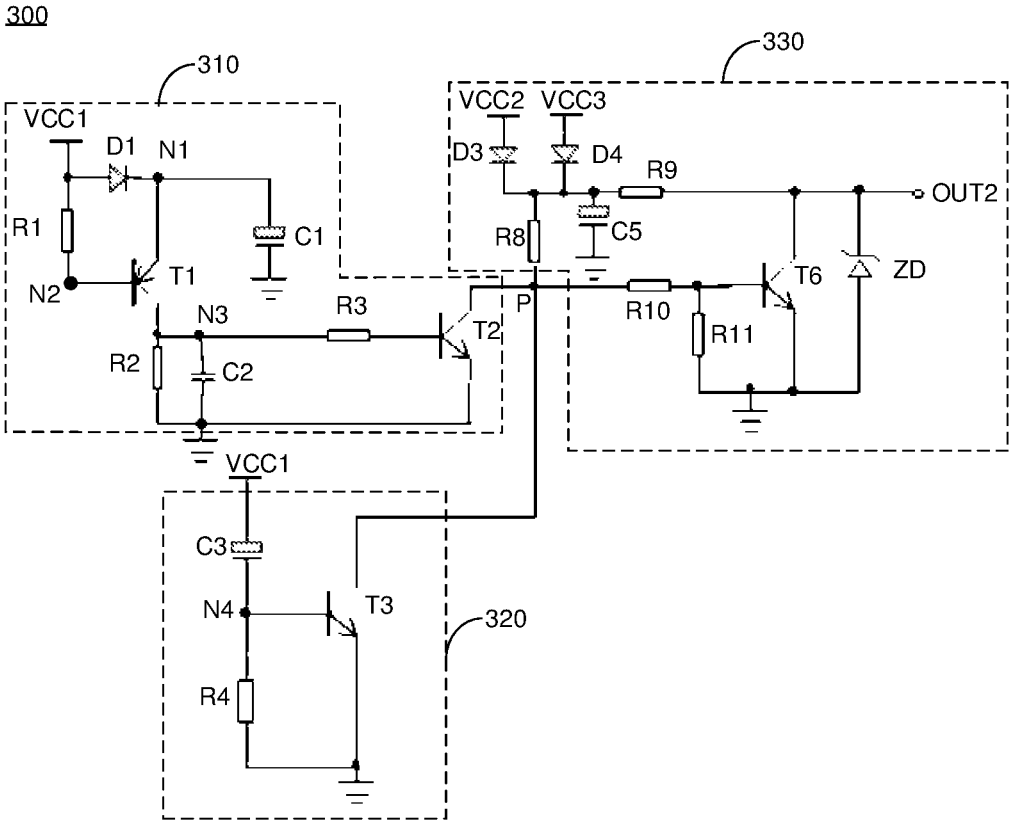
FIG. 3A shows a circuit diagram of the device for controlling backlight according to another embodiment of the present disclosure.

FIG. 3A shows a circuit diagram of the device for controlling backlight according to another embodiment of the present disclosure. The device for controlling backlight 300 of FIG. 3A is similar to the device for controlling backlight 200 of FIG. 2A, except that the device for controlling backlight 300 further comprises a third controlling circuit 330. For brevity, the differences will be mainly described in detail below.

As shown in FIG. 3A, the device for controlling backlight 300 comprises a first controlling circuit 310, a second controlling circuit 320 and a third controlling circuit 330. The first controlling circuit 310 may be implemented in the same way as the first controlling circuit 210 described above, and the second controlling circuit 320 may be implemented in the same way as the second controlling circuit 220 described above, which are not repeated here. The first controlling circuit 310 and the second controlling circuit 320 are electrically connected to the second outputting terminal OUT2 via the third controlling circuit 330. The third controlling circuit 330 may be configured to invert the output signal generated by the first controlling circuit 310 and the second controlling circuit 320, and output an inverted output signal via a second outputting terminal OUT2 of the device for controlling backlight 300.

As shown in FIG. 3A, the second electrode of the second transistor T2 in the first controlling circuit 310 serves as the outputting terminal of the first controlling circuit 310, and the second electrode of the third transistor T3 in the second controlling circuit 320 serves as the outputting terminal of the second controlling circuit 320, both of which are connected to the node P. The third controlling circuit 330 includes a sixth transistor T6, an eighth resistor R8, and a ninth resistor R9. The controlling electrode of the sixth transistor T6 is electrically connected to the node P, so as to receive the output signal generated by the first controlling circuit 310 or the second controlling circuit 320. The first electrode of the sixth transistor T6 is grounded, and the second electrode of the sixth transistor T6 is electrically connected to the second outputting terminal OUT2 of the device for controlling backlight 300. The first terminal of the eighth resistor R8 is electrically connected to a second power supply signal terminal (for example, the power supply signal terminal VCC2 or VCC3 in FIG. 3A) for providing a second power supply signal, and the second terminal of the eighth resistor R8 is electrically connected to the controlling electrode of the six transistor T6. A first terminal of the ninth resistor R9 is electrically coupled to the second power supply signal terminal, and a second terminal of the ninth resistor R9 is electrically coupled to the second outputting terminal OUT2 of the device for controlling backlight. In this embodiment, the sixth transistor T6 may be an N-type transistor, however, the embodiments of the present disclosure are not limited thereto, and the type of the transistor may be selected as needed.

The second power supply signal terminal may be the same signal terminal as the first power supply signal terminal VCC1, so that the second power supply signal from the second power supply signal terminal is the same as the first power supply signal from the first power supply signal terminal VCC1. The second power supply signal terminal may be different from the first power supply signal terminal VCC1. For example, a power supply signal terminal that discharges more slowly than the first power supply signal terminal VCC1 may be selected as the second power supply signal terminal, that is, the discharging of the second power supply signal is completed after the discharging of the first power supply signal. For example, the first power supply signal and the second power supply signal may be set so that the second power supply signal is still at a high level within a period of time after the first power supply signal changes from a high level to a low level and becomes stable, when the power is turned off. In FIG. 3A, one of the power supply signal terminals VCC2 and VCC3 can be adopted as the second power supply signal terminal, wherein the power supply signal terminal VCC2 can be the same as the first power supply signal terminal VCC1, and the power supply signal terminal VCC3 may discharge more slowly than the first power supply signal terminal VCC1. By setting the second power supply signal terminal (such as VCC2 or VCC3), it is possible to provide a bias voltage, so that the third controlling circuit 330 can still operate after the first power supply signal terminal VCC1 becomes a low level, when turning off the device, thereby inverting the output signal generated by the first controlling circuit 310. By setting a power supply signal which discharges more slowly than the first power supply signal at the first power supply signal terminal VCC1 as the second power supply signal at the second power supply signal terminal, it is enabled that the discharging at the second power supply signal terminal has not been completed (for example, still at a high level) within a period of time after the discharging of the first power supply signal is completed (for example, the first power supply signal is discharged from a high level to a low level and then stabilized), enabling the third controlling circuit 330 to operate normally.

In some embodiments, the third controlling circuit 330 may further include a third diode (such as one of the diodes D3 and D4 in FIG. 3A), a fifth capacitor C5, a tenth resistors R10 and an eleventh resistor R11. A first electrode of the third diode is electrically coupled to the second power supply signal terminal, and a second electrode of the third diode is electrically coupled to the first terminal of the eighth resistor R8 and the first terminal of the ninth resistor R9. For example, in FIG. 3A, when the power supply signal terminal VCC2 is used as the second power supply signal terminal, the third diode is the diode D3; when the power supply signal terminal VCC3 is used as the second power supply signal terminal, the third diode is the diode D4. The first electrode of the fifth capacitor C5 is electrically connected to the first terminal of the eighth resistor R8 and the first terminal of the ninth resistor R9, and the second electrode of the fifth capacitor C5 is grounded. The controlling electrode of the sixth transistor T6 is electrically connected to the second terminal of the eighth resistor R8 via the tenth resistor R10, so as to receive the output signal generated by the first controlling circuit 310 or the second controlling circuit 310. The controlling electrode of the sixth transistor T6 is grounded via the eleventh resistor R11. By using a third diode (such as the diode D3 or D4) and the fifth capacitor C5, it is possible to ensure that the second transistor T2 and the sixth transistor T6 are provided with a bias current when the device for controlling backlight is turned on and off frequently. The eighth resistor R8 can be used as a power supply bias resistor for the second transistor T2, and the ninth resistor R9 can be used as a power supply bias resistor for the sixth transistor T6. In some embodiments, the third controlling circuit 330 may further include a voltage stabilizing diode ZD. A first electrode of the voltage stabilizing diode ZD is grounded, and a second electrode of the voltage stabilizing diode ZD is electrically coupled to the second outputting terminal OUT2 of the device for controlling backlight 300. The voltage stabilizing diode ZD can protect the voltage matching at the enabling signal terminal of the backlight module.

The device for controlling backlight 300 of FIG. 3A can be applied to a low-level-enabled backlight module. For example, the second outputting terminal OUT2 of the device for controlling backlight 300 can be coupled to the enabling signal terminal of the backlight module.

When turning on the device, the first power supply signal terminal VCC1 is at a high level, the first transistor T1 is turned off, the first controlling circuit 310 does not operate, and the third capacitor C3 in the second controlling circuit 320 starts to charge. During the charging of the third capacitor C3, the third transistor T3 is turned on, thereby pulling down the node P to a low level. The low level at the node P causes the sixth transistor T6 to be turned off, and the second outputting terminal OUT2 is at a high level under the bias voltage from the second power supply signal terminal (such as VCC2 or VCC3), so that the enabling signal terminal of the backlight module is also at a high level, and the backlight module does not emit light (that is, it is turned off). After a period of time, the third capacitor C3 is fully charged, the third transistor T3 is turned off, and the node P is at a high level under the bias voltage of the second power supply signal terminal (such as VCC2 or VCC3). The high level at the node P cause the sixth transistor T6 to be turned on, thereby pulling down the output signal from the second outputting terminal OUT2 to a low level. The low level at the second outputting terminal OUT2 enables the enabling signal terminal of the backlight module to be at a low level, and then the backlight module is turned on.

When turning off the device, the first power supply signal terminal VCC1 is at a low level, the third transistor T3 is turned off, the second controlling circuit 320 does not operate. The first transistor T1 in the first controlling circuit 310 is turned on, so that the controlling electrode of the second transistor T2 is at a high level, turning on the second transistor T2. The turning on of the second transistor T2 pulls the node P to a low level. The low level at the node P causes the sixth transistor T6 to be turned off, and the second outputting terminal OUT2 is at a high level under the bias voltage from the second power supply signal terminal (such as VCC2 or VCC3), so that the enabling signal terminal of the backlight module is also at a high level, and the backlight module does not emit light.

Figure 3B:
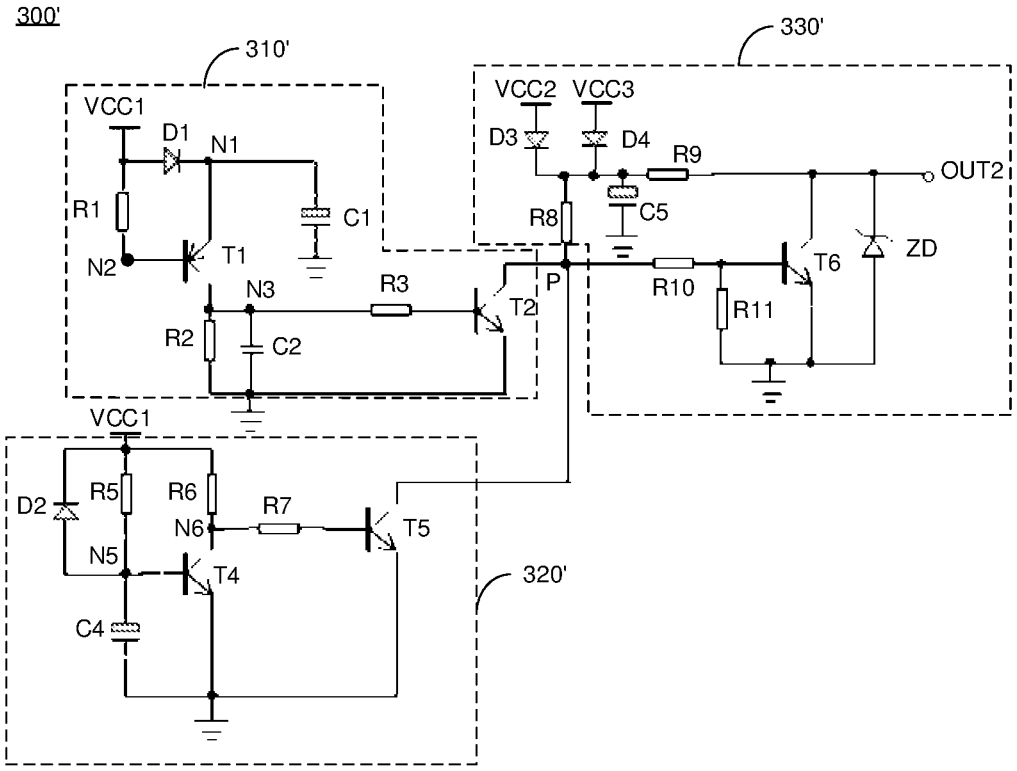
FIG. 3B shows a circuit diagram of the device for controlling backlight according to another embodiment of the present disclosure.

FIG. 3B shows a circuit diagram of the device for controlling backlight according to another embodiment of the present disclosure. The device for controlling backlight 300' of FIG. 3B is similar to the device for controlling backlight 300 of FIG. 3A, except for the second controlling circuit 320'. For brevity, the differences will be mainly described in detail below.

As shown in FIG. 3B, the device for controlling backlight 300' may comprise a first controlling circuit 310', a second controlling circuit 320' and a third controlling circuit 330'. The first controlling circuit 310' may be implemented in the same way as the first controlling circuit 310 described above, and the third controlling circuit 330' may be implemented in the same way as the third controlling circuit 330 described above, which are not repeated here. The second controlling circuit 320' in FIG. 3B may be implemented in the same way as the second controlling circuit 220' in the embodiment above described with reference to FIG. 2B, which is not repeated here.

The device for controlling backlight 300' of FIG. 3B can also be applied to a low-level-enabled backlight module. For example, the second outputting terminal OUT2 of the backlight control device 300' can be coupled to the enabling signal terminal of the backlight module. When turning on the device, similar to the process described above with reference to FIG. 3A, the first power supply signal terminal VCC1 is at a high level, the first controlling circuit 310 ' does not operate, the second controlling circuit 320' causes the node P to become a high level after being at a low level for a predetermined time period, and the inverting function of the third controlling circuit 330' causes the backlight module to be turned on after being kept in a turned off state for the predetermined time period. When turning off the device, similar to the process described above with reference to FIG. 3A, the first power supply signal terminal VCC1 is at a low level, the second controlling circuit 320 ' does not operate, the first controlling circuit 310' pulls the node P down to a low level, and the inverting function of the third controlling circuit 330' causes the backlight module to be turned on.

An example circuit structure of a device for controlling backlight according to another embodiment of the present disclosure will be described below with reference to FIGS. 4A and 4B. The device for controlling backlight of FIG. 4A and FIG. 4B can be applied to a low-level-enabled backlight module. For example, the outputting terminal of the device for controlling backlight can be electrically coupled to the enabling signal terminal of the backlight module, which is low-level enabled. The difference from FIG. 3A and FIG. 3B is that the device for controlling backlight of FIG. 4A and FIG. 4B is suitable for the case where the enabling signal terminal of the backlight module is provided with a bias circuit and a voltage stabilization circuit, so it can have a simpler structure.

Figure 4A:
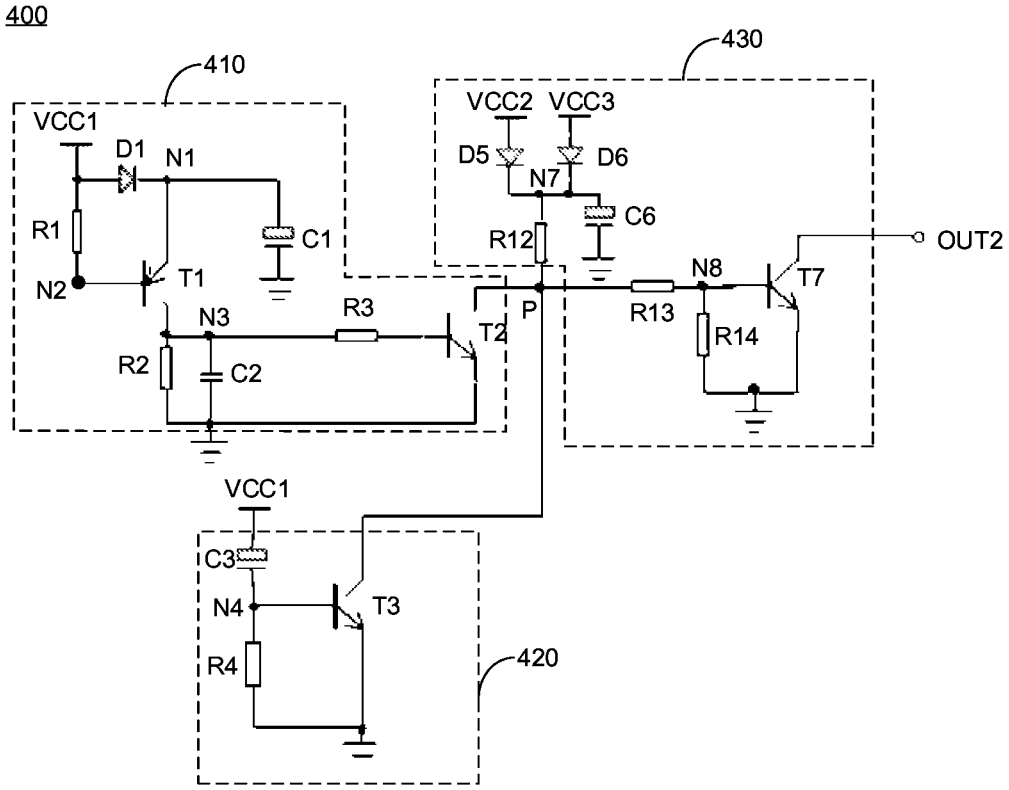
FIG. 4A shows a circuit diagram of the device for controlling backlight according to another embodiment of the present disclosure.
Figure 4B:
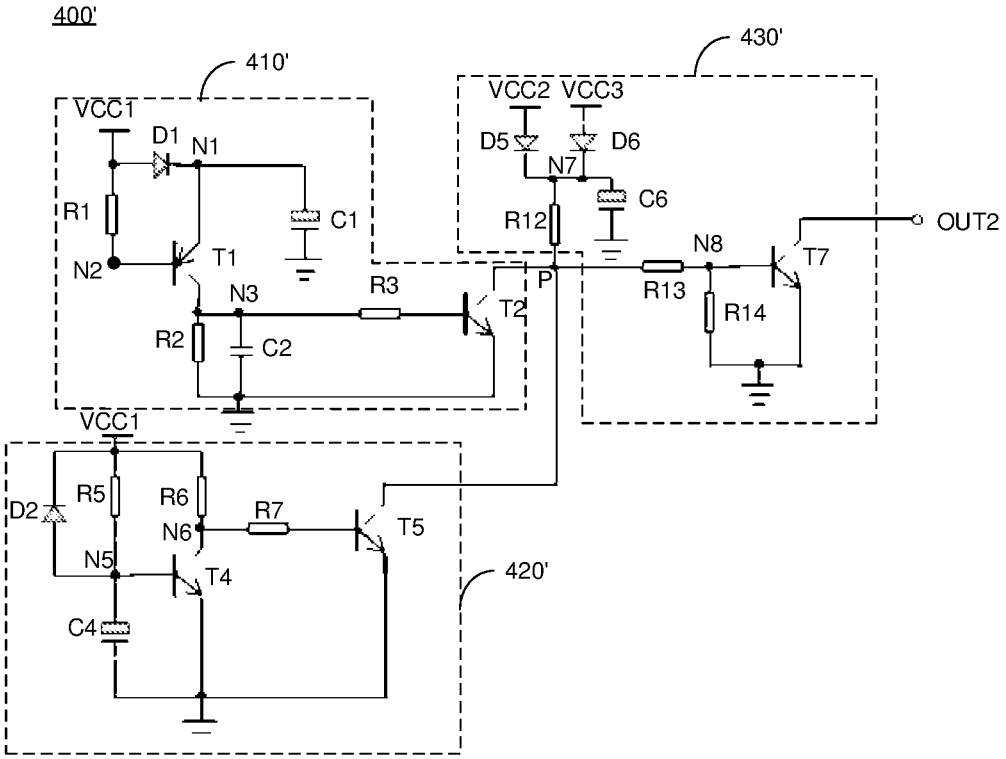
FIG. 4B shows a circuit diagram of the device for controlling backlight according to another embodiment of the present disclosure.

FIG. 4A shows a circuit diagram of the device for controlling backlight according to another embodiment of the present disclosure. The device for controlling backlight 400 of FIG. 4A is similar to the backlight control device 300 of FIG. 3A, except for the third controlling circuit 430. For brevity, the differences will be mainly described in detail below.

As shown in FIG. 4A, the device for controlling backlight 400 comprises a first controlling circuit 410, a second controlling circuit 420 and a third controlling circuit 430. The first controlling circuit 410 may be implemented in the same way as the first controlling circuit 310 described above, and the second controlling circuit 420 may be implemented in the same way as the second controlling circuit 320 described above, which are not repeated here.

The third controlling circuit 430 may be configured to invert the output signal generated by the first controlling circuit 410 or the second controlling circuit 420, and output an inverted output signal via a second outputting terminal OUT2 of the device for controlling backlight 400. As shown in FIG. 4A, the third controlling circuit 430 includes a fourth diode (for example, one of the diodes D5 and D6 in FIG. 4A), a seventh transistor T7, a sixth capacitor C6, a twelfth resistor R12, a thirteenth resistor R13 and fourteenth resistor R14. A first electrode of the fourth diode is electrically coupled to a second power supply signal terminal for providing a second power supply signal (for example, VCC2 or VCC3), and a second electrode of the fourth diode is electrically coupled to a seventh node N7. A controlling electrode of the seventh transistor T7 is electrically coupled to the eighth node N8, a first electrode of the seventh transistor T7 is grounded, and a second electrode of the seventh transistor T7 is electrically coupled to the second outputting terminal OUT2 of the device for controlling backlight 400. A first electrode of the sixth capacitor C6 is electrically coupled to the seventh node N7, and a second electrode of the sixth capacitor C6 is grounded. A first terminal of the twelfth resistor R12 is electrically coupled to the seventh node N7, and a second terminal of the twelfth resistor R12 is electrically coupled to the node P, so as to receive the output signal from the first controlling circuit 410 or the second controlling circuit 420. A first terminal of the thirteenth resistor R13 is electrically coupled to the node P, and a second terminal of the thirteenth resistor R13 is electrically coupled to the eighth node N8. A first terminal of the fourteenth resistor R14 is electrically coupled to the eighth node N8, and a second terminal of the fourteenth resistor R14 is grounded. FIG. 4B shows a circuit diagram of the device for controlling backlight according to another embodiment of the present disclosure. The device for controlling backlight 400' of FIG. 4B is similar to the device for controlling backlight 400 of FIG. 4A, except for the second controlling circuit 420'. For brevity, the differences will be mainly described in detail below.

As shown in FIG. 4B, the device for controlling backlight 400' comprises a first controlling circuit 410', a second controlling circuit 420' and a third controlling circuit 430'. The first controlling circuit 410' may be implemented in the same way as the first controlling circuit 410 described above, and the third controlling circuit 430' may be implemented in the same way as the third controlling circuit 430 described above, which are not repeated here. The second controlling circuit 420' in FIG. 4B may be implemented in the same way as the second controlling circuit 220' in the embodiment above described with reference to FIG. 2B, which is not repeated here.

An example circuit structure of a device for controlling backlight according to the embodiment of the present disclosure will be described below with reference to FIGS. 5A and 5B. The device for controlling backlight of FIG. 5A and FIG. 5B can be applied to a backlight module without the enabling signal terminal. For example, the outputting terminal OUT of the device for controlling backlight can be electrically coupled to the power supply terminal of the backlight module (for example, the power supply terminal of LED strap).

Figure 5A:
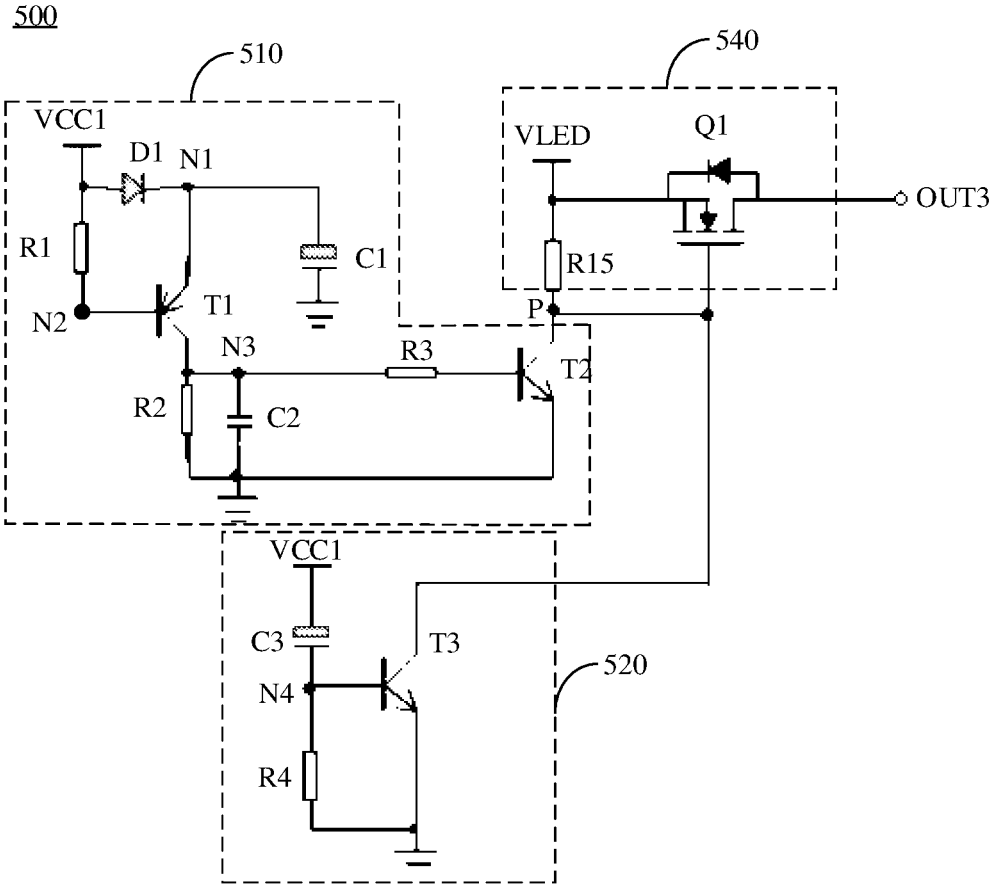
FIG. 5A shows a circuit diagram of the device for controlling backlight according to another embodiment of the present disclosure.

FIG. 5A shows a circuit diagram of the device for controlling backlight according to another embodiment of the present disclosure. The device for controlling backlight 500 of FIG. 5A is similar to the device for controlling backlight 200 of FIG. 2A, except that the device for controlling backlight 500 further comprises a fourth controlling circuit 540. For brevity, the differences will be mainly described in detail below.

As shown in FIG. 5A, the device for controlling backlight 500 comprises a first controlling circuit 510, a second controlling circuit 520 and a fourth controlling circuit 540. The first controlling circuit 510 may be implemented in the same way as the first controlling circuit 210 described above, and the second controlling circuit 520 may be implemented in the same way as the second controlling circuit 220 described above, which are not repeated here.

The fourth controlling circuit 540 may be configured to provide, a third power supply signal for powering the backlight module at the third power supply signal terminal VLED, to a third outputting terminal OUT3 of the device 500, based on the output signal generated by the first controlling circuit 510 or the second controlling circuit 520. As shown in FIG. 5A, the fourth controlling circuit 540 may include a fifteenth resistor R15 and a switching transistor Q1. A first terminal of the fifteenth resistor R15 is electrically coupled to a third power supply signal terminal VLED for providing the third power supply signal, and a second terminal of the fifteenth resistor R15 is electrically coupled to the node P, so as to receive the output signal generated by the first controlling circuit 510 or the second controlling circuit 520. A controlling electrode of the switching transistor Q1 is electrically coupled to the second terminal of the fifteenth resistor R15, a first electrode of the switching transistor Q1 is electrically coupled to the third power supply signal terminal VLED, and a second electrode of the switching transistor Q1 is electrically coupled to the third outputting terminal OUT3 of the device for controlling backlight 500.

When turning on the device, the first power supply signal terminal VCC1 is at a high level, the first controlling circuit 510 does not operate, and the second controlling circuit 520 enables the node P to change into a high level after being kept in a low level for a predetermined time period. The level at the node P causes the switching transistor Q1 to be turned on after being in a turned off state for a predetermined time period, so that the power supply terminal of the backlight module is electrically connected to the third power supply signal terminal VLED after the predetermined time period is elapsed, thereby enabling the backlight module to wait for lighting until the powering on of the timing controller T-CON is completed.

When turning off the device, the first power supply signal terminal VCC1 is at a low level, the second controlling circuit 520 does not operate, and the first controlling circuit 510 pulls the node P down to a low level. The low level at the node P turns off the switching transistor Q1, so that the power supply terminal of the backlight module is disconnected from the third power supply signal terminal VLED, and thus the backlight module is turned off.

In some embodiments, the switching transistor Q1 may be a metal-oxide-semiconductor field-effect transistor (MOSFET), which may have better switching performance. Exemplarily, a controlling electrode of the MOSFET may be the gate, and a first electrode and a second electrode of the MOSFET may be the source and the drain, respectively, wherein the first electrode and the second electrode may be interchangeable. The first transistor T1, the second transistor T2, the third transistor T3, the fourth transistor T4, the fifth transistor T5, the sixth transistor T6, and the seventh transistor T7 may be bipolar junction transistors (BJT). Exemplarily, the controlling electrode of the BJT may be the base, the first electrode of the BJT may be the emitter, and the second electrode of the BJT may be the collector. However, the embodiments of the present disclosure are not limited thereto, and the types of the above-mentioned transistors may be selected as needed. In FIG. 5A, the N-channel enhancement mode MOSFET transistor is taken as an example to describe the switching transistor Q1. However, the embodiment of the present disclosure is not limited thereto. The switching transistor Q1 may also be an N-channel depletion mode MOSFET transistor, a P-channel enhancement mode MOSFET transistor, a P-channel depletion mode MOSFET transistor and the like. In this case, circuit structures can be configured correspondingly, so that the fourth controlling circuit 540 can function as a switch.

Figure 5B:
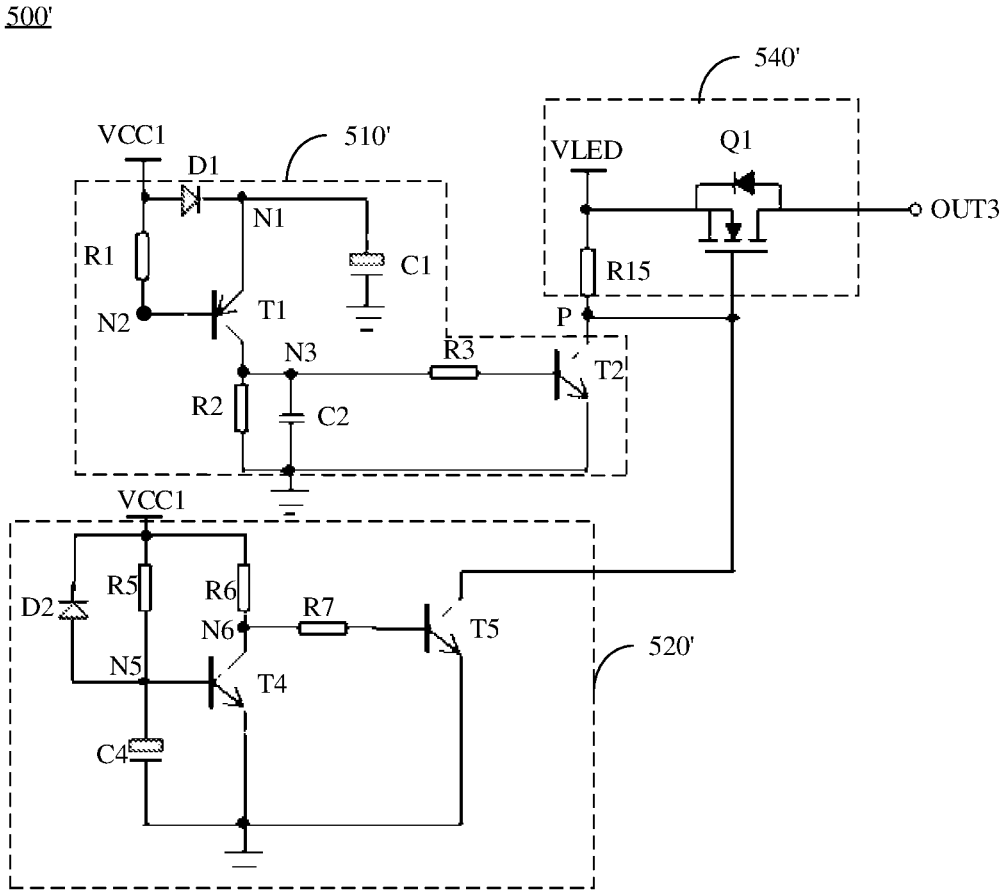
FIG. 5B shows a circuit diagram of the device for controlling backlight according to another embodiment of the present disclosure.

FIG. 5B shows a circuit diagram of the device for controlling backlight according to another embodiment of the present disclosure. The device for controlling backlight 500' of FIG. 5B is similar to the device for controlling backlight 500 of FIG. 5A, except for the second controlling circuit 520'. For brevity, the differences will be mainly described in detail below.

As shown in FIG. 5B, the device for controlling backlight 500' comprises a first controlling circuit 510', a second controlling circuit 520' and a fourth controlling circuit 540'. The first controlling circuit 510' may be implemented in the same way as the first controlling circuit 510 described above, and the fourth controlling circuit 540' may be implemented in the same way as the fourth controlling circuit 540 described above, which are not repeated here. The second controlling circuit 520' in FIG. 5B may be implemented in the same way as the second controlling circuit 220' in the embodiment above described with reference to FIG. 2B, which is not repeated here.

Although in the above embodiments, the transistors T1, T2, T3, T4, T5, T6 and T7 are all triodes, wherein the transistor T1 may be a P-type transistor, and the transistors T2, T3, T4, T5, T6 and T7 may be N-type transistors, and the switching transistor Q1 may be an N-channel enhancement mode MOSFET transistor. However, the embodiments of the present disclosure are not limited thereto, and the types of the transistors may be selected as needed. In addition, in the above embodiments, the first capacitor C1, the third capacitor C3, the fourth capacitor C4, the fifth capacitor C5, and the sixth capacitor C6 may be polar capacitors, and the second capacitor C2 may be a non-polar capacitor. However, the embodiments of the present disclosure are not limited thereto, and the types of the capacitors may be selected as needed.

Figure 6:
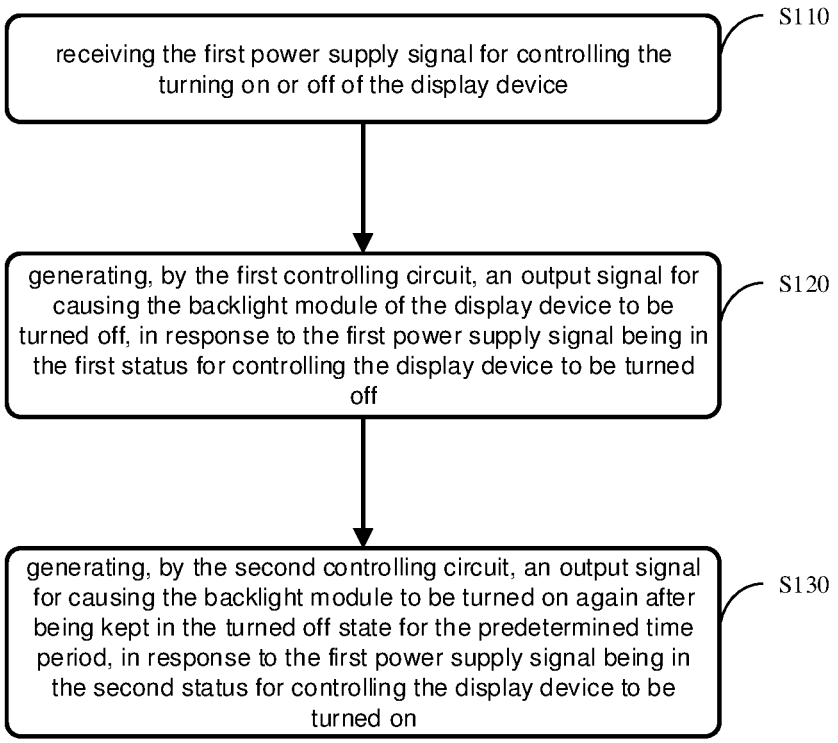
FIG. 6 shows a flowchart diagram illustrating a method for controlling backlight according to an embodiment of the present disclosure.

FIG. 6 shows a flowchart diagram illustrating a method for controlling backlight according to an embodiment of the present disclosure. This method can be executed by the device for controlling backlight of any of the above embodiments, so as to control the turning on or off of the backlight module of the display device.

In step S110, the first power supply signal for controlling the turning on or off of the display device is received. The first power supply signal may be a power supply signal for powering the display driving circuit (such as a timing controller T-CON) in the display device, wherein the first power supply signal at the first power supply signal terminal generally has a voltage of 5V or 12V. The first power supply signal at the first level (for example, a high level) is being in a second status for controlling the display device (for example, the timing controller T-CON of the display device) to be turned on, and the first power supply signal at the second level (for example, a low level) is being in a first status for controlling the display device (for example, the timing controller T-CON of the display device) to be turned off. The predetermined time period may be longer than the time required for the display driving circuit in the display device to be powered on, for example, longer than the time required for the power supply voltage Vcore in the timing controller T-CON, voltage Vio at GPIO terminals, other logic voltages and the like being stabilized.

In step S120, an output signal for causing the backlight module of the display device to be turned off is generated by the first controlling circuit, in response to the first power supply signal being in the first status for controlling the display device to be turned off.

In step S130, an output signal for causing the backlight module to be turned on again after being kept in the turned off state for the predetermined time period is generated by the second controlling circuit, in response to the first power supply signal being in the second status for controlling the display device to be turned on.

For example, the first controlling circuit and the second controlling circuit may generate the output signal in a manner described in any of the embodiments with reference to FIG. 2A, FIG. 2B, FIG. 3A, FIG. 3B, FIG. 4A, FIG. 4B, FIG. 5A, and FIG. 5B. In the case where the backlight control device further includes a third controlling circuit, for example, in the case that the backlight control device has any of the example structures described above with reference to FIG. 3A, FIG. 3B, FIG. 4A, and FIG. 4B, the first controlling circuit, the second controlling circuit, and the third controlling circuit may operate in the manner described above with reference to any one of the embodiments in FIG. 3A, FIG. 3B, FIG. 4A, and FIG. 4B. In the case where the backlight control device further includes a fourth controlling circuit, for example, in the case that the backlight control device has any of the example structures described above with reference to FIG. 5A, and FIG. 5B, the first controlling circuit, the second controlling circuit, and the fourth controlling circuit may operate in the manner described above with reference to any one of the embodiments in FIG. 5A, and FIG. 5B, which will not be discussed herein.

Figure 7:
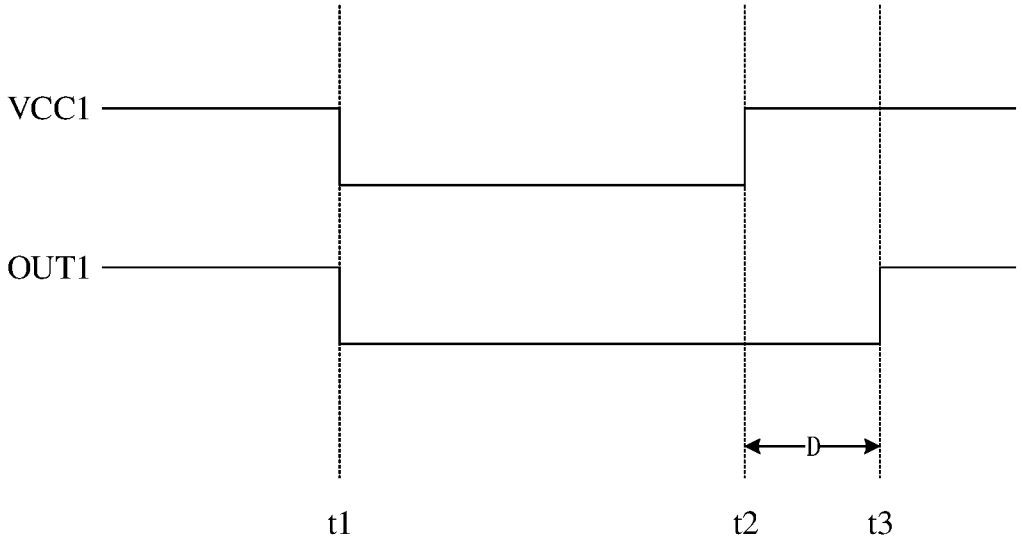
FIG. 7 shows a signal timing diagram of the method for controlling backlight according to an embodiment of the present disclosure.

FIG. 7 shows a signal timing diagram of the method for controlling backlight according to an embodiment of the present disclosure. The method for controlling backlight of FIG. 7 will be described below by taking the device for controlling backlight 200 of FIG. 2A as an example.

At time t1, the display device is turned off, the first power supply signal terminal VCC1 may provide the first power supply signal being in a first status, and the first power supply signal terminal VCC1 for powering the display driving circuit of the display device is at a low level. With reference to FIG. 2A, the low level at the first power supply terminal VCC1 turns off the third transistor T3, and the second controlling circuit 220 does not operate. The first transistor T1 in the first controlling circuit 210 is turned on, so that the controlling electrode of the second transistor T2 is at a high level, turning on the second transistor T2. The turning on of the second transistor T2 cause the output signal of the first outputting terminal OUT1 to be pulled down to a low level, so that the enabling signal terminal of the backlight module is at a low level, and the backlight module is turned off.

At time t2, the display device is turned on, the first power supply signal terminal VCC1 may provide the first power supply signal being in a second status, and the first power supply signal terminal VCC1 for powering the display driving circuit of the display device is at a high level. With reference to FIG. 2A, the high level at the first power supply signal terminal VCC1 turns off the first transistor T1, and the first controlling circuit 210 does not operate. The third capacitor C3 in the second controlling circuit 220 starts to charge. During the charging of the third capacitor C3, the third transistor T3 is turned on, thereby pulling down the output signal of the first outputting terminal OUT1 to a low level, so that the enabling signal terminal of the backlight module is at a low level, and the backlight module does not emit light (that is, it is kept in a turned off state).

At time t3, the charging of the third capacitor C3 is completed, the third transistor T3 is turned off, and the level at the first outputting terminal OUT1 is no longer pulled down, so that the enabling signal terminal of the backlight module returns to a high level, causing the backlight module to be turned on. For example, the third capacitor C3 and the fourth resistor R4 are set such that the charging time D for the third capacitor C3 (i.e. a time period from time t2 to time t3) under the voltage of the first power supply signal terminal VCC1 is equal to the above-mentioned predetermined time period, which may be longer than the timed required for respective power supply voltage Vcore in the display driving circuit (for example, timing controller T-CON), the voltage at the GPIO terminal, other logic voltages and the like being stabilized after being powered. Therefore, the second controlling circuit 220 can ensure that the enabling signal terminal of the backlight module is at a low level before the powering on of the timing controller T-CON is completed, and the level at the enabling signal terminal of the backlight module is stopped to be pulled down after the powering on of the timing controller T-CON is completed, thereby enabling the backlight module to be turned on normally.

Figure 8:
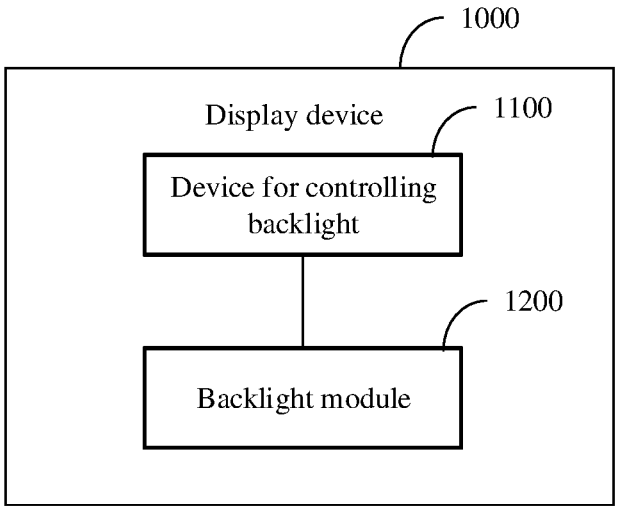
FIG. 8 shows a schematic block diagram illustrating a display device according to an embodiment of the present disclosure.

FIG. 8 shows a schematic block diagram illustrating a display device according to an embodiment of the present disclosure.

As shown in FIG. 8, the display device 1000 may include a device for controlling backlight 1100 and a backlight module 1200. The device for controlling backlight 1100 may be implemented with the device of any of the embodiments described above with reference to FIG. 1, FIG. 2A, FIG. 2B, FIG. 3A, FIG. 3B, FIG. 4A, FIG. 4B, FIG. 5A, and FIG. 5B.

The backlight module 1200 is electrically connected to the device for controlling backlight 1100. The backlight module 1200 may be turned on or off under the control of an output signal from the device for controlling backlight 1100.

For example, in a case where the device for controlling backlight 1100 has any of the example structures described above with reference to FIG. 2A and FIG. 2B, the backlight module 1200 may have a high-level enabled enabling signal terminal, which is electrically connected to the first outputting terminal OUT1 of the device for controlling backlight 1100. In a case where the device for controlling backlight 1100 has any of the example structures described above with reference to FIG. 3A, FIG. 3B, FIG. 4A and FIG. 4B, the backlight module 1200 may have a low-level enabled enabling signal terminal, which is electrically connected to the second outputting terminal OUT2 of the device for controlling backlight 1100. In a case where the device for controlling backlight 1100 has any of the example structures described above with reference to FIG. 5A and FIG. 5B, the backlight module 1200 may not have an enabling signal terminal, and the third outputting terminal OUT3 of the device for controlling backlight 1100 is electrically connected to the power supply terminal of the backlight module

1200 (for example, a power supply terminal of an LED strap in the backlight module 1200), and a third power supply signal terminal VLED of the device for controlling backlight 1100 is a power supply signal terminal for supplying power to the power supply terminal of the backlight module 1200. The display device 1000 may further include a display panel and a display driving circuit, and a driving signal generated by the display driving circuit drives the backlight module and the display panel to emit light. For example, the display driving circuit may include, for example, a timing controller T-CON, a gate driving circuit, and a source driving circuit, which may be each implemented as an independent chip or may be integrated together. The device for controlling backlight 1100 can monitor the power supply signal for powering the display driving circuit as the first power supply signal. For example, the backlight control device 1100 can monitor the power supply signal for powering the timing controller T-CON as the first power supply signal. Certainly, other power supply signals for supplying power to the display driving circuit can also be monitored as the first power supply signal. In some embodiments, even the turning on/off signal or the power supply voltage of the entire display device or the display module of the display device can be monitored as the first power supply signal. The display device 1000 may be various devices having a display function, including but not limited to a display, a mobile phone, a television, a desktop computer, a tablet computer, a laptop computer, and the like.

Those skilled in the art would understand that the embodiments described above are all exemplary, and various modifications can be made. The structures described in the various embodiments can be freely combined without conflicts in structure or principle.

After a detailed description of the preferred embodiments of the present disclosure, those skilled in the art can clearly understand that various changes and modifications can be made without departing from the scope and spirit of the appended claims, and the embodiments of the present disclosure are not limited to the implementation of the exemplary embodiments described in the description.

We claim:

1. A device for controlling backlight, comprising:

a first controlling circuit configured to receive a first power supply signal for controlling a display device to be turned on or off, and generate an output signal for causing a backlight module of the display device to be turned off, in response to the first power supply signal being in a first status for controlling the display device to be turned off; and a second controlling circuit having a different circuit structure than the first controlling circuit, and being configured to receive the first power supply signal, and generate an output signal for causing the backlight module to be turned on again after being kept in a turned off state for a predetermined time period, in response to the first power supply signal being in a second status for controlling the display device to be turned on, wherein the first controlling circuit comprises:

a second capacitor, wherein a first electrode of the second capacitor is electrically coupled to a third node, and a second electrode of the second capacitor is grounded; and a third resistor, wherein a first terminal of the third resistor is electrically coupled to the third node, and a second terminal of the third resistor is electrically coupled to a controlling electrode of a second transistor, wherein the second controlling circuit comprises:

a third capacitor, wherein a first electrode of the third capacitor is directly connected to a first power supply signal terminal for providing the first power supply signal, and a second electrode of the third capacitor is directly connected to a fourth node;

a fourth resistor, wherein a first terminal of the fourth resistor is directly connected to the fourth node, and a second terminal of the fourth resistor is grounded; and a third transistor, wherein a controlling electrode of the third transistor is directly connected to the fourth node, a first electrode of the third transistor is grounded, and a second electrode of the third transistor is directly connected to a first outputting terminal for outputting the output signal.

2. The device of claim 1, wherein the first controlling circuit further comprises:

a first diode, wherein a first electrode of the first diode is electrically coupled to a first power supply signal terminal for providing the first power supply signal, and a second electrode of the first diode is electrically coupled to a first node;

a first capacitor, wherein a first electrode of the first capacitor is electrically coupled to the first node, and a second electrode of the first capacitor is grounded;

a first transistor, wherein the controlling electrode of the first transistor is electrically coupled to a second node, a first electrode of the first transistor is electrically coupled to the first node, and a second electrode of the first transistor is electrically coupled to the third node;

a first resistor, wherein a first terminal of the first resistor is electrically coupled to the first power supply signal terminal, and a second terminal of the first resistor is electrically coupled to the second node;

a second resistor, wherein a first terminal of the second resistor is electrically coupled to the third node, and a second terminal of the second resistor is grounded; and the second transistor, wherein a controlling electrode of the second transistor is electrically coupled to the third node, a first electrode of the second transistor is grounded, and a second electrode of the second transistor is electrically coupled to a first outputting terminal for outputting the output signal.

3. The device of claim 2, wherein the first transistor is a P-type transistor, and the second transistor is an N-type transistor.

4. The device of claim 1, wherein the second controlling circuit comprises:

a fourth transistor, wherein a controlling electrode of the fourth transistor is electrically coupled to a fifth node, a first electrode of the fourth transistor is grounded, and a second electrode of the fourth transistor is electrically coupled to a sixth node;

a second diode, wherein a first electrode of the second diode is electrically coupled to the fifth node, and a second electrode of the second diode is electrically coupled to a first power supply signal terminal for providing the first power supply signal;

a fourth capacitor, wherein a first electrode of the fourth capacitor is electrically coupled to the fifth node, and a second electrode of the fourth capacitor is grounded;

a fifth transistor, wherein a controlling electrode of the fifth transistor is electrically coupled to the sixth node via a seventh resistor, a first electrode of the fifth transistor is grounded, and a second electrode of the fifth transistor is electrically coupled to a first outputting terminal for outputting the output signal;

a fifth resistor, wherein a first terminal of the fifth resistor is electrically coupled to the first power supply signal terminal, and a second terminal of the fifth resistor is electrically coupled to the fifth node;

a sixth resistor, wherein a first terminal of the sixth resistor is electrically coupled to the first power supply signal terminal, and a second terminal of the sixth resistor is electrically coupled to the sixth node; and the seventh resistor, wherein a first terminal of the seventh resistor is electrically coupled to the sixth node, and a second terminal of the seventh resistor is electrically coupled to the controlling electrode of the fifth transistor.

5. The device of claim 1, further comprising: a third controlling circuit configured to invert the output signal generated by the first controlling circuit and the second controlling circuit, and output an inverted output signal via a second outputting terminal of the device for controlling backlight.

6. The device of claim 5, wherein the third controlling circuit comprises:

an eighth resistor, wherein a first terminal of the eighth resistor is electrically coupled to a second power supply signal terminal for providing a second power supply signal, and a second terminal of the eighth resistor is electrically coupled to a first outputting terminal for outputting the output signal;

a ninth resistor, wherein a first terminal of the ninth resistor is electrically coupled to the second power supply signal terminal, and a second terminal of the ninth resistor is electrically coupled to the second outputting terminal; and a sixth transistor, wherein a controlling electrode of the sixth transistor is electrically coupled to the first outputting terminal, a first electrode of the sixth transistor is grounded, and a second electrode of the sixth transistor is electrically coupled to the second outputting terminal.

7. The device of claim 6, wherein the third controlling circuit further comprises:

a third diode, wherein a first electrode of the third diode is electrically coupled to the second power supply signal terminal, and a second electrode of the third diode is electrically coupled to the first terminal of the eighth resistor and the first terminal of the ninth resistor;

a fifth capacitor, wherein a first electrode of the fifth capacitor is coupled to the second electrode of the third diode, and a second electrode of the fifth capacitor is grounded;

a tenth resistor, wherein a first terminal of the tenth resistor is electrically coupled to the first outputting terminal, and a second terminal of the tenth resistor is electrically coupled to the controlling electrode of the sixth transistor;

an eleventh resistor, wherein a first terminal of the eleventh resistor is electrically coupled to the controlling electrode of the sixth transistor, and a second terminal of the eleventh resistor is grounded; and a voltage stabilizing diode, wherein a first electrode of the voltage stabilizing diode is grounded, and a second electrode of the voltage stabilizing diode is electrically coupled to the second outputting terminal.

8. The device of claim 6, wherein the second power supply signal is the same as the first power supply signal, or a discharging duration required for the second power supply signal to change from a first level to a second level is longer than the discharging duration required for the first power supply signal to change from the first level to the second level.

9. The device of claim 5, wherein the third controlling circuit comprises:

a fourth diode, wherein a first electrode of the fourth diode is electrically coupled to a second power supply signal terminal for providing a second power supply signal, and a second electrode of the fourth diode is electrically coupled to a seventh node;

a twelfth resistor, wherein a first terminal of the twelfth resistor is electrically coupled to the seventh node, and a second terminal of the twelfth resistor is electrically coupled to a first outputting terminal for outputting the output signal;

a sixth capacitor, wherein a first electrode of the sixth capacitor is electrically coupled to the seventh node, and a second electrode of the sixth capacitor is grounded;

a seventh transistor, wherein a controlling electrode of the seventh transistor is electrically coupled to the eighth node, a first electrode of the seventh transistor is grounded, and a second electrode of the seventh transistor is coupled to the second outputting terminal;

a thirteenth resistor, wherein a first terminal of the thirteenth resistor is electrically coupled to the first outputting terminal, and a second terminal of the thirteenth resistor is electrically coupled to the eighth node; and a fourteenth resistor, wherein a first terminal of the fourteenth resistor is electrically coupled to the eighth node, and a second terminal of the fourteenth resistor is grounded.

10. The device of claim 1, further comprising a fourth controlling circuit, configured to provide a third power supply signal for powering the backlight module to a third outputting terminal of the device, based on the output signal generated by the first controlling circuit or the second controlling circuit.

11. The device of claim 10, wherein the fourth controlling circuit comprises:

a fifteenth resistor, wherein a first terminal of the fifteenth resistor is electrically coupled to a third power supply signal terminal for providing the third power supply signal, and a second terminal of the fifteenth resistor is electrically coupled to a first outputting terminal for outputting the output signal; and a switching transistor, wherein a controlling electrode of the switching transistor is electrically coupled to the first outputting terminal, a first electrode of the switching transistor is electrically coupled to the third power supply signal terminal, and a second electrode of the switching transistor is electrically coupled to the third outputting terminal.

12. The device of claim 11, wherein the switching transistor is a MOSFET transistor.

13. The device of claim 1, wherein the first power supply signal is a voltage signal for powering a display driving circuit in the display device.

14. The device of claim 13, wherein the predetermined time period is longer than a time period required for powering on the display driving circuit.

15. A display device comprising:

the device for controlling backlight of claim 1; and the backlight module, electrically coupled to the device for controlling backlight, and configured to be turned on or off under a control of the output signal provided by the device for controlling backlight.

16. A method for controlling backlight performed by the device for controlling backlight of claim 1, the method comprising:

receiving the first power supply signal for controlling the turning on or off of the display device;

generating, by the first controlling circuit, an output signal for causing the backlight module of the display device to be turned off, in response to the first power supply signal being in the first status for controlling the display device to be turned off; and generating, by the second controlling circuit, an output signal for causing the backlight module to be turned on again after being kept in the turned off state for the predetermined time period, in response to the first power supply signal being in the second status for controlling the display device to be turned on.

* * * * *